US007249993B2

(12) United States Patent
Wagner

(10) Patent No.: US 7,249,993 B2
(45) Date of Patent: Jul. 31, 2007

(54) MACHINING APPARATUS FOR SKIS HAVING A BINDING

(75) Inventor: Josef Wagner, Weilbach (AT)

(73) Assignee: Wintersteiger AG, Ried (AT)

( * ) Notice: Subject to any disclaimer, the term of this patent is extended or adjusted under 35 U.S.C. 154(b) by 1 day.

(21) Appl. No.: 11/345,562

(22) Filed: Feb. 1, 2006

(65) Prior Publication Data

US 2006/0171789 A1 Aug. 3, 2006

(30) Foreign Application Priority Data

Feb. 1, 2005 (AT) ..... A 158/2005

(51) Int. Cl.
*B24B 49/00* (2006.01)

(52) U.S. Cl. ..... 451/11; 451/336; 451/393

(58) Field of Classification Search ..... 451/11, 451/331–339, 213, 393, 383; 76/83
See application file for complete search history.

(56) References Cited

U.S. PATENT DOCUMENTS 4,577,586 A * 3/1986 Morris et al. ..... 118/63
4,869,024 A * 9/1989 Gladek ..... 451/213
4,939,873 A * 7/1990 Smialek ..... 451/28
4,987,282 A * 1/1991 Chastain ..... 219/76.14
5,209,780 A * 5/1993 Partel ..... 118/59

FOREIGN PATENT DOCUMENTS

AT 397 925 B 8/1994
EP 0 631 841 B1 1/1995

* cited by examiner

*Primary Examiner*—Dung Van Nguyen
(74) *Attorney, Agent, or Firm*—Collard & Roe, P.C.

(57) ABSTRACT

The invention describes a machining apparatus for skis (5) having a binding (16), comprising a roller table (6) for the skis (5) resting with the running surface on the rollers (9) of the roller table, tools (2) provided between the rollers (9) of the roller table for machining the running surface and the edges of the skis (5), and a feed device for the skis (5) which presses the skis (5) against the rollers (9) of the roller table. In order to provide advantageous constructional conditions it is proposed that the feed device comprises at least one guide (10) for a drivable carriage (11), which guide is provided above the roller table (6) and extends parallel to the same, and which carriage carries holding-down devices (13) for the ski which are distributed over the length of the ski.

9 Claims, 3 Drawing Sheets

MACHINING APPARATUS FOR SKIS HAVING A BINDING

CROSS REFERENCE TO RELATED APPLICATIONS

Applicant claims priority under 35 U.S.C. §119 of Austrian Application No. A 158/2005 filed Feb. 1, 2005.

1. Field of the Invention

The invention relates to a machining apparatus for skis having a binding, comprising a roller table for the skis resting with the running surface on the rollers of the roller table, tools provided between the roller table rollers for machining the running surface and the edges of the skis, and a feed device for the skis pressing the skis against the rollers of the roller table.

2. Description of the Prior Art

In order to clamp skis with mounted bindings in a manner suitable for machining and in order to enable the forward feed of the same with a respective longitudinal feed to the machining tools for the running surface and the edges of the ski, it is known (AT 397 925 B) to provide a roller table on which the skis can be placed with the running surface and are pressed down with the help of holding-down rollers. The machining tools are arranged between the rollers of the roller table, with the tools for machining the running surface and the lower edges being applied from below with a predetermined pressing force against the ski to be machined. The holding-down rollers are driven for the longitudinal forward feed of the skis. In order to enable the conveyance of the skis over the driven holding-down rollers along the roller table, the holding-down rollers need to be able to evade the binding of the ski. This is achieved with bridging brackets which are inserted into the ski bindings and which form a roller table for the holding-down rollers. For this purpose, said holding-down rollers are pressed in a resilient manner against the skis and are adjustably held against the spring force. Apart from the constructional complexity in connection with the arrangement of such holding-down rollers along the roller table, there is a disadvantage in handling the skis in that prior to the machining of the skis the bridging brackets need to be inserted into the skis and need to be removed from them again after the machining. Moreover, different bridging brackets are required for different ski lengths and different ski bindings.

In another known machining apparatus (EP 0 631 841 B1), the skis are received by a carriage which is movable along a guide and which comprises mounts which are arranged as adjusting cylinders, are supported on the upper side of the ski and are distributed over the length of the ski, of which at least two mounts situated outside of the region of the binding comprise suckers. The ski attached to these mounts and supported on the mounts is moved past the machining tools situated beneath the carriage track, with the mounts of the carriage defining the working plane. The disadvantageous aspect in such apparatuses is especially that as a result of the different surface profiles of the different skis it is not always possible to ensure the fixing of the ski by means of the suckers. Moreover, there is an increased abrasion by grinding in the region of the mounts as a result of the support of the ski exclusively on the mounts, which abrasion can be noticed especially in the case of a repeated machining of a ski.

SUMMARY OF THE INVENTION

The invention is thus based on the object of providing a machining apparatus for skis with bindings of the kind mentioned above in such a way that a clamping of the skis can be ensured in a manner suitable for machining in combination with the lowest possible need for handling the same.

This object is achieved by the invention in such a way that the feed device comprises at least one guide for a drivable carriage, which guide is provided above the roller table and extends parallel to the same and which carriage carries holding-down devices for the ski which are distributed over the length of the ski.

Since the skis to be machined are entrained by the holding-down devices of the carriage during a forward feed movement of the carriage as a result of these measures, the local assignment of the holding-down devices relative to the ski is maintained during the forward feed, so that the ski binding does not constitute an obstruction for the forward feed when the binding area is taken in account accordingly in the distribution of the holding-down devices. A ski to be machined can therefore be pressed against the rollers of the roller table with the help of the holding-down devices of the carriage and be displaced simultaneously along the roller table in such a way that advantageous machining conditions can be ensured for the machining tools applied from below. The pressing force of the holding-down devices must be chosen higher than the machining forces which act perpendicular to the running surface. Moreover, the static friction between the holding-down devices and the ski to be machined must be higher than machining forces acting upon the ski in the longitudinal direction. By observing these conditions, a longitudinal forward feed is enabled which is substantially independent of different ski sizes and shapes, this being in combination with an advantageous clamping of the skis in a manner suitable for machining without requiring any special handling of the skis for preparing the machining.

The holding-down devices can be held in an adjustable manner on the carriage for adjusting the holding-down devices to the respective length of the ski. The constructional effort linked with such a displacement of the holding-down devices can be avoided when the holding-down devices which are provided at a predetermined distance in the longitudinal direction of the ski are applied depending on the length of the ski, so that after an alignment of the holding-down devices relative to the binding region only the holding-down devices of the carriage which are situated within the length of the ski are applied and press the ski against the roller table. Since in the case of a respective alignment of the ski relative to the holding-down devices a middle holding-down device can be placed on the ski between the jaws of the binding, a usually provided ski brake can be swiveled upwardly to the idle position with the help of said middle holding-down device and can be kept in this idle position which releases the lateral edges. With the provision of a middle holding-down device as a holding device for a ski brake it is no longer necessary to provide a separate holding device for the ski brake, so that the handling actions required in connection with the fixing of the ski brake can be omitted.

In order to keep the pressing forces of the holding-down devices at a low level depending on the occurring machining forces without endangering the forward feed of the ski, the holding-down devices can be provided with a friction lining in the application area, which lining increases static friction between the holding-down devices and the surface of the ski. The holding-down devices can also be subjected to different pressures in order to take into account different machining forces and different pretensions as a result of the curvature of the ski in the longitudinal direction of the ski.

When the roller table is equipped with two parallel roller paths for skis placed at a lateral distance from each other it is possible to considerably increase the throughput of the skis to be machined, even when machining tools for only one ski are provided because in this case it is possible to avoid an empty stroke of the forward feed device. This is achieved with even only one single carriage when it is ensured that the skis can be applied on the two roller paths by means of respective holding-down devices of the carriage. Each roller path can be associated with separate holding-down devices for this purpose. It is also possible to displace the holding-down devices laterally in order to machine a further ski in the opposite direction of feed after the machining of a ski in the one direction of feed of the carriage. Especially advantageous constructional conditions are obtained in this connection when two parallel guides associated with a roller path each are provided above the roller table for a carriage each with holding-down devices. Of these carriages, one can be driven back in an empty stroke during the working stroke of the other carriage in order to ensure continuous machining of directly successive skis. In a roller table with two roller paths situated adjacent to each other, the rollers of the roller table can advantageously have a length extending over both roller paths, thus not only leading to a constructional simplification, but also allowing the machining of snowboards.

The centering of the skis to be machined relative to the longitudinal axis of the roller paths can be achieved not only by way of separate conventional centering stops which are moved against each other in opposite directions transversally to the longitudinal axis of the roller paths, but also with the help of the holding-down devices when such holding-down devices are provided with respective centering surfaces, so that during the application of the holding-down devices to the upper side of the ski, the ski is aligned in a central manner between the centering surfaces which run apart in a wedge-like manner.

BRIEF DESCRIPTION OF THE DRAWINGS

The subject matter of the invention is shown in the drawings, wherein.

DESCRIPTION OF THE PREFERRED EMBODIMENT

Figure 1:
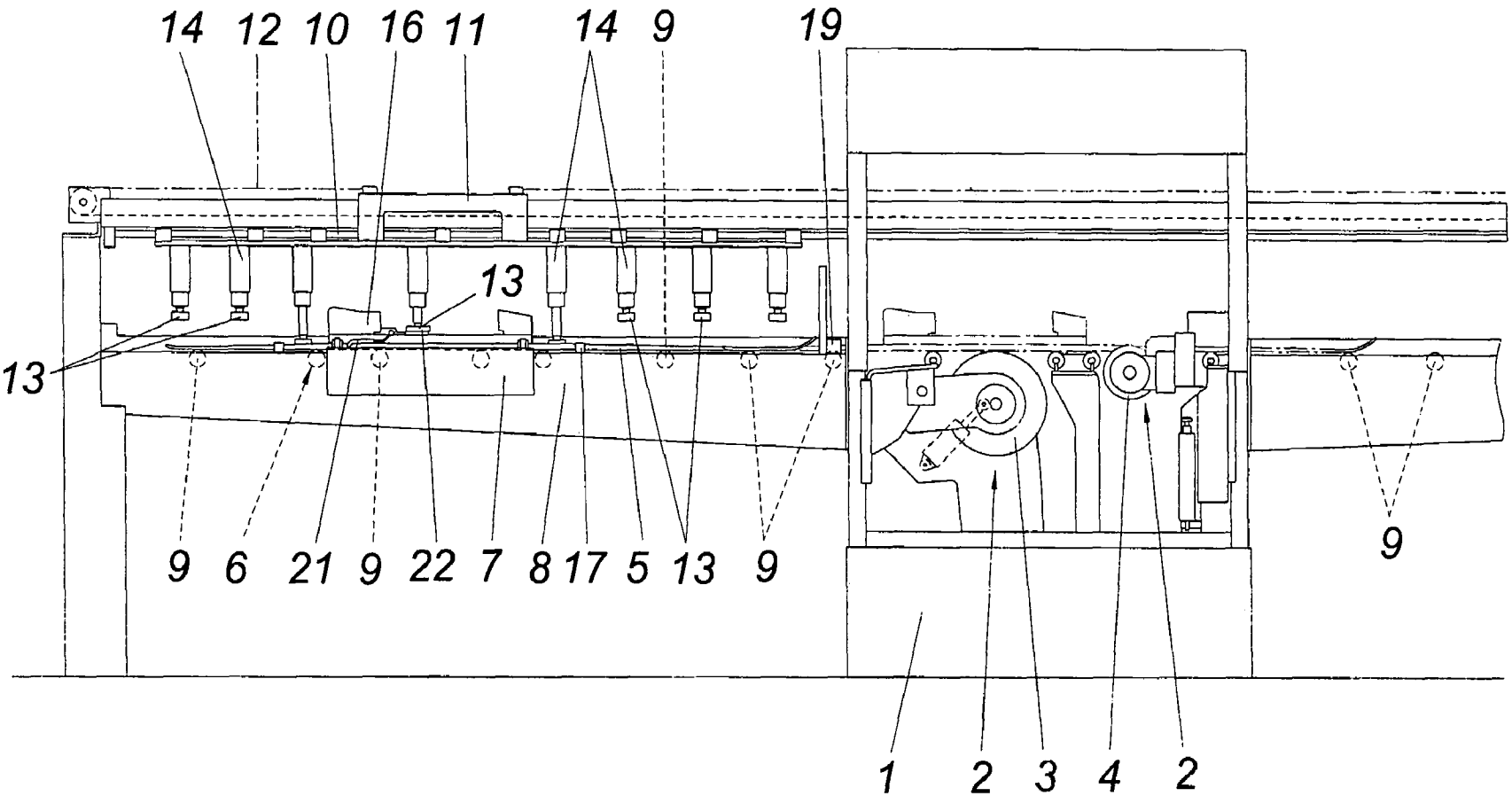
FIG. 1 shows a simplified side view of a machining apparatus in accordance with the invention for a ski.

The illustrated machining apparatus for skis comprising a frame 1 with machining tools 2, e.g. a grinding wheel 3 for the running surface and a grinding device 4 for the edges of a ski, which ski is clamped down in a manner suitable for machining on a roller table 6 and is moved past the machining tools 2. The skis 5 to be machined are delivered to the roller table 6 by way of a cross conveyor 7 which is provided in a charging section of the roller table 6 upstream of frame 1. For this purpose a support 8 is connected to frame 1 for the charging section of the roller table 6 and the cross conveyor 7, which support is adjustably held about a swiveling axis extending in the conveying direction of the roller table 6 in order to convey the skis 5 to be machined at first above the conveying plane of the roller table 6 to the region of the roller table 6 and allow them to rest on the rollers 9 of the roller table by pivoting down the cross conveyor 7.

Above the roller table 6, which forms two adjacently situated roller paths for the skis 5, two guides 10 which are parallel to the roller paths are provided for a carriage 11 each which can be displaced along the associated guide 10 by means of a traction means 12 (e.g. a synchronous belt drive) guided about deflection pulleys. The carriages 11 comprise holding-down devices 13 which are distributed over the length of a ski 5 and which press the skis 5 to be machined with the help of adjusting cylinders 14 with their running surface against the rollers 9 of the roller table. These holding-down devices 13, which are preferably provided with a friction lining 15, lead in cooperation with the rollers 9 of the roller table in the region of the machining tools 2 not only to a clamping of the skis 5 which is suitable for machining, but also act as entrainment means when the carriages 11 are displaced along the guides 10, so that the skis 5 are subjected to a longitudinal forward feed by the carriages 11 along the roller table 6.

Although forward feed devices are provided for two skis 5 on the adjacently situated roller paths of the roller table 6 according to the illustrated embodiment, there are only machining tools for the simultaneous machining of only one ski 5. This means that the skis 5 on the two roller paths of the roller table 5 can only be processed successively, but not simultaneously, thus requiring a set of tools each for the two roller paths. Throughput can still be increased considerably however, because during the working stroke of the one carriage 11 the other carriage can be conveyed back in an empty stroke to the charging section of the roller table 6 in order to receive a further ski 5 for machining.

Figure 2:
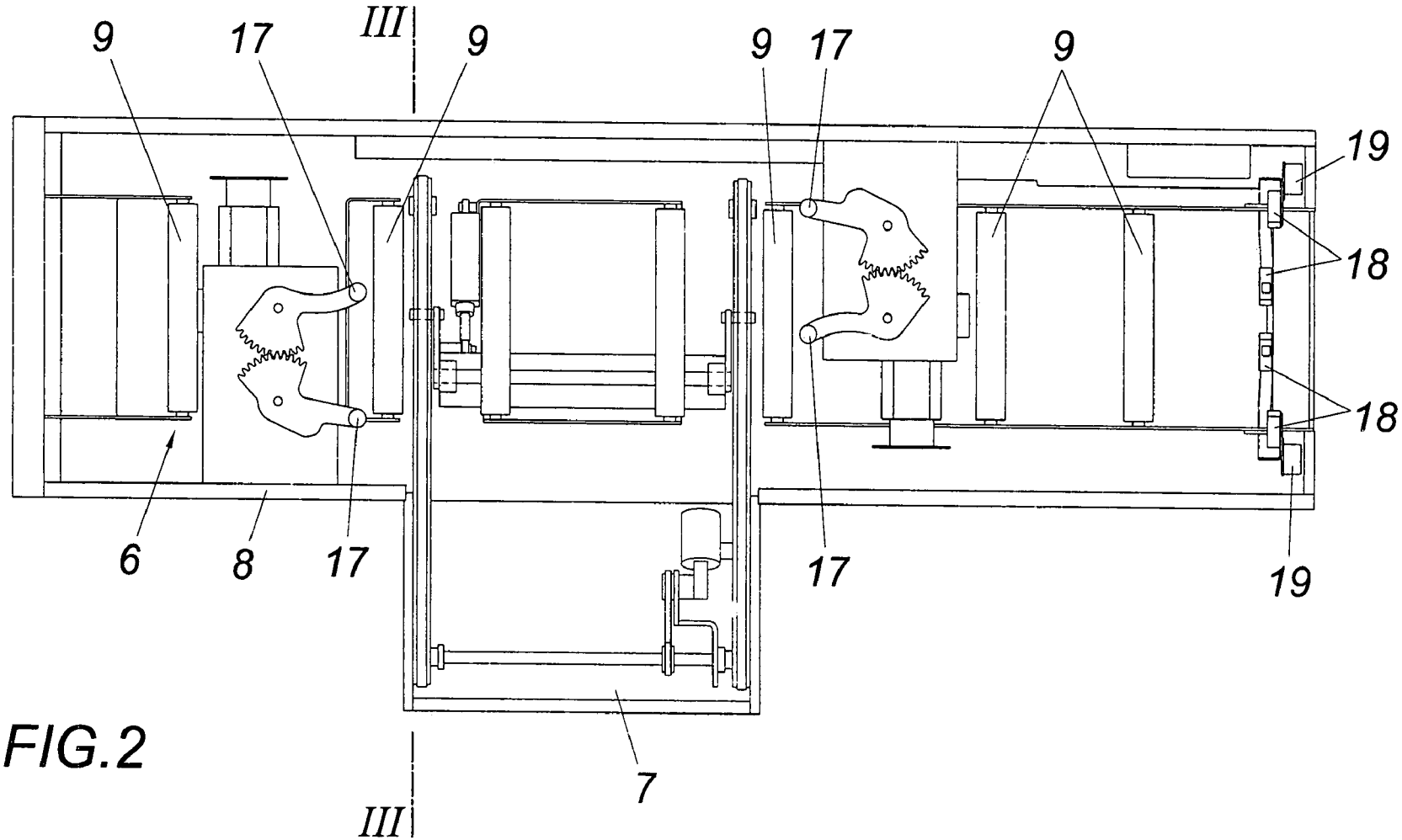
FIG. 2 shows the charging section of the roller table of said machining apparatus in a simplified top view.

The skis 5 which are aligned relative to the bindings 16 on the cross conveyor 7 with the help of the longitudinal stop for the bindings 16 must be centered with respect to the direction of forward feed after being deposited on the rollers 9 of the roller table. For this purpose centering stops 17 are provided which are adjusted symmetrically to the longitudinal axis of the two roller paths and align the respective ski relative to said roller path in order to thereafter clamp down the aligned ski 5 by way of the three middle holding-down devices 13 against the roller table 6. Since the centering stops 17 are arranged jointly for the two roller paths, these centering stops 17 need to be aligned on respective transversal guides relative to the two roller paths. In FIG. 2, the centering stops 17 for the front and rear ski region are each associated with a different roller path. The three middle holding-down devices 13 grasp the ski 5 between the binding jaws and directly outside of the binding jaws of the ski binding 16, so that said middle holding-down device 13 can be applied irrespective of the respective ski length. The other holding-down devices 13 are applied depending on the respective ski length. A sensor 18, preferably a light barrier, is thus provided for the ski length in the output region of the charging section of the roller table 6, which length is determined during the removal of the ski 5 from the charging section of the roller table 6 in order to apply the holding-down devices 13 situated in the region of the ski length depending on the determined length of the ski before the ski is conveyed to the region of the machining tools 2. A respective clamping of the skis 5 is only required in the machining region of the tools 2. Moreover, a measurement transducer 19 is provided for the width of the ski, so that the application force of the grinding wheel 3 on the running surface can be chosen depending on the ski width for example.

Figure 3:
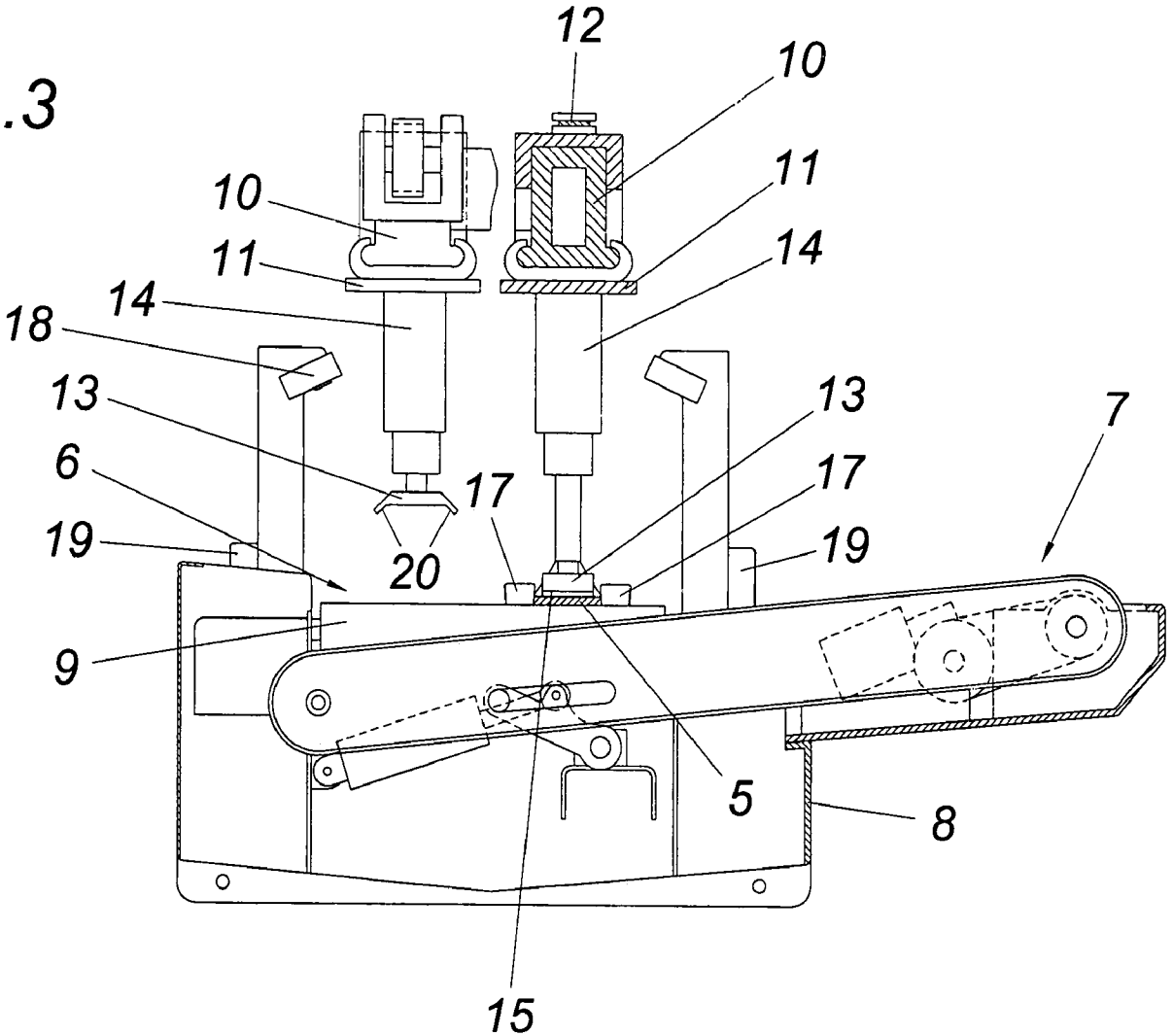
FIG. 3 shows a sectional view along the line III-III of FIG. 2.

The centering of the skis 5 can occur not only by way of the centering stops 17, but also with the help of the holding-down devices 13. For this purpose the holding-down devices 13 are provided with centering surfaces 20 which run apart in a wedge-like fashion, as is indicated in FIG. 3.

In order to tightly hold an optionally provided ski brake 21 in the upwardly swiveled idle position during the machining of the ski, the middle holding-down device 13 grasping between the binding jaws can be provided with a plate 22 which is applied to the ski brake 21 and upwardly swivels the same to the idle position.

It is not necessary to stress in particular that by providing two roller paths next to one another the machining tools 2 either have to have a working width which allows the machining of the skis on both roller paths or they must be aligned relative to the two roller paths. A respective width of the grinding wheel is also recommended for machining the running surfaces also with respect to the fact that snowboards can be machined with such a machining apparatus. The grinding devices 4 for the edges must be offset laterally according to the machined ski 5 on one of the two roller paths.

The invention claimed is:

1. A machining apparatus for skis having a binding, comprising a roller table for the skis resting with the running surface on the rollers of the roller table, tools provided between the rollers of the roller table for machining the running surface and the edges of the skis, and a feed device for the skis which presses the skis against the rollers of the roller table, wherein the feed device comprises at least one guide (10) for a drivable carriage (11), which guide is provided above the roller table (6) and extends parallel to the same, and which carriage carries holding-down devices (13) for the ski which are distributed over the length of the ski.

2. A machining apparatus according to claim 1, wherein the holding-down devices (13) provided at a predetermined distance in the longitudinal direction of the skis can be applied depending on the length of the ski.

3. A machining apparatus according to claim 1, wherein a middle holding-down device (13) forms a holding device for a ski brake of the ski binding (16).

4. A machining apparatus according to claim 1, wherein the holding-down devices (13) comprise a friction lining (15) in the application area on the skis (5).

5. A machining apparatus according to claim 1, wherein the holding-down devices (13) can be applied with different pressure.

6. A machining apparatus according to claim 1, wherein the roller table (6) comprises two parallel roller paths for skis (5) which can be deposited with a lateral distance from each other.

7. A machining apparatus according to claim 6, wherein above the roller table (6) two parallel guides (10) are provided for a carriage (11) each with holding-down devices (13), which guides are each associated with a roller path.

8. A machining apparatus according to claim 6, wherein the rollers (9) of the roller table have a length extending over both roller paths.

9. A machining apparatus according to claim 1, wherein the holding-down devices (13) comprise centering surfaces (20) for the respective ski (5) to be machined.

* * * * *